US007106996B2

(12) United States Patent
Funamizu et al.

(10) Patent No.: US 7,106,996 B2
(45) **Date of Patent: *Sep. 12, 2006**

(54) IMAGE FORMING APPARATUS

(75) Inventors: Yoshihiro Funamizu, Chiba (JP); Tomohiro Tamaoki, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/185,779

(22) Filed: Jul. 21, 2005

(65) Prior Publication Data

US 2005/0249526 A1 Nov. 10, 2005

Related U.S. Application Data

(62) Division of application No. 10/665,423, filed on Sep. 22, 2003, now Pat. No. 6,965,747.

(30) Foreign Application Priority Data

Sep. 27, 2002 (JP) ..... 2002-283982

(51) Int. Cl.

| | |
|---|---|
| ***G03G 15/00*** | (2006.01) |
| ***G03G 15/01*** | (2006.01) |
| ***G03G 15/04*** | (2006.01) |
| ***G03G 15/16*** | (2006.01) |
| ***G03G 15/22*** | (2006.01) |

(52) U.S. Cl. ..... 399/301; 399/6; 399/66; 399/194; 399/296; 399/308

(58) Field of Classification Search ..... 399/6, 399/51, 66, 194, 296, 297, 298, 299, 301, 399/302, 308; 347/116

See application file for complete search history.

(56) References Cited

U.S. PATENT DOCUMENTS

| | | | | |
|---|---|---|---|---|
| 4,652,115 | A | 3/1987 | Palm et al. | |
| 5,160,946 | A | 11/1992 | Hwang | 346/157 |
| 6,091,922 | A | 7/2000 | Bisaiji | 399/297 |
| 6,259,879 | B1 | 7/2001 | Bisaiji | 399/296 |
| 6,285,849 | B1 | 9/2001 | Shimada et al. | 399/301 |
| 6,434,354 | B1 | 8/2002 | Bisaiji | 399/296 |
| 6,694,114 | B1 | 2/2004 | Matsuduki | 399/66 |
| 6,718,150 | B1 | 4/2004 | Matsuduki | 399/194 |
| 2001/0007616 | A1 | 7/2001 | Bisaiji | 399/296 |
| 2004/0091291 | A1 | 5/2004 | Tamaoki | 399/297 |

FOREIGN PATENT DOCUMENTS

| | | |
|---|---|---|
| JP | 11-52758 | 2/1999 |
| JP | 11-316532 | 11/1999 |

*Primary Examiner*—Sandra L. Brase
(74) *Attorney, Agent, or Firm*—Fitzpatrick, Cella, Harper & Scinto

(57) ABSTRACT

An image forming apparatus has a movable image bearing member, a image forming device for forming a developer image on the image bearing member, and an intermediate transfer member on which the developer image on the image bearing member is transferred while it is moving at a predetermined surficial moving speed different from the surficial moving speed of the image bearing member. The image forming apparatus forms a predetermined image prior to formation of a normal image.

10 Claims, 10 Drawing Sheets

IMAGE FORMING APPARATUS

CROSS-REFERENCE TO RELATED APPLICATION

This application is a divisional of application Ser. No. 10/655,423, filed Sep. 22, 2003 now U.S. Pat. No. 6,965,747.

BACKGROUND OF THE INVENTION

1. Field of the Invention

The present invention relates to an image forming apparatus utilizing an electrostatic process or an electrophotographic recording process, etc., and particularly relates to an image forming apparatus that uses an intermediate transfer member onto which a developed image is primarily transferred and from which the developed image is secondarily transferred onto a transferring material.

2. Related Background Art

Conventionally, there have been used image forming apparatus provided with a plurality of image forming portions, each of which irradiates a laser beam or a light beam from a light emitting element such as an LED that is light-modulated based on image information onto an image bearing member such as a photosensitive drum to form an electrostatic latent image in accordance with an electrophotography process, then develops the electrostatic latent image by developing means accommodating developer to form a developed image (or a toner image), and transfers it onto a transferring material conveyed by a transferring material conveying member or an intermediate transfer member.

In addition, there have been proposed image forming apparatus for forming color images by forming toner images of different colors by means of the aforementioned plurality of image forming portions respectively and transferring the toner images of the respective colors onto a transferring material in a multi-layer manner while conveying the transferring material to the positions opposed to the respective image forming portions by means of a transferring material conveying member, or by transferring the toner images of the respective colors onto an intermediate transfer member in a multi-layer manner and then transferring them onto a transferring material at one time (intermediate transfer method).

In many cases, an endless belt that is looped around a driving roller for transmitting drive and at least one driven roller so that its surface will be moved is used as the intermediate transfer member. In this specification, endless belts serving as intermediate transfer belts will be collectively referred to as "transferring belts." In addition, since a photosensitive drum is often used as the image bearing member, the image bearing member will be referred to as "a photosensitive drum."

In the above-mentioned type of image forming apparatus, in order to improve transfer latitude (or transfer efficiency) upon transferring from the photosensitive drum to the transferring belt, it is considered to be effective to set a primary transferring current optimally. However, this involves difficulties since a transfer error tends to occur when the primary transferring current is low and re-transfer tends to occur when the primary transferring current is high.

In view of the above, it is a common practice to create a difference in peripheral speed between the photosensitive drum and the transferring belt in order to improve the primary transfer latitude. According to a presently proposed technology, by virtue of the peripheral speed difference, transferring is performed taking advantage of a shear force functioning to scoop the toner image on the photosensitive drum, so that an improvement and a stabilization of the primary transfer latitude upon primary transfer of the toner image on the photosensitive drum are attained and "uneven density" in images and "voids" in lines or character images are prevented from occurring. With this technology, voids can be prevented especially in the central portion of thin lines of a secondary color and an improvement in transfer latitude can be expected.

However, in the case that a peripheral speed difference always exists between the photosensitive drum and the transferring belt, a frictional force is present between them.

Consequently, the coefficient of friction varies depending on presence/absence of toner between the photosensitive drum and the transferring belt, and therefore the rotation speed of the photosensitive drum varies. As a result, image exposure on the photosensitive drum is blurred, and streaked images are sometimes generated at the leading edge portion of an image.

In connection with this, Japanese Patent Application Laid-Open No. H11-52758 discloses a structure for an apparatus that forms images while performing a control to make the surface speed of a photosensitive member and the surface speed of an intermediate transfer belt equal to each other. In the structure disclosed in this document, a dot toner image is formed on a drum before the first toner image is primarily transferred, in order to eliminate the problem that a misregistered image can be generated due to a partial speed difference that is abruptly generated between the photosensitive member and the intermediate transfer belt by an effect of the stress between those members that is created due to eccentricity of a roller on which the belt is looped or by a mounting error of those members.

SUMMARY OF THE INVENTION

In view of the above, an object of the present invention is to provide an image forming apparatus in which a peripheral speed difference always exists between an image bearing member and an intermediate transfer member and which can form high quality images while suppressing variations in the moving speed of the image bearing member upon image formation and preventing image errors such as streaked images from occurring.

A preferable image forming apparatus according to the present invention that attains the above object comprises:

a movable image bearing member;

image forming means for forming a developer image on the image bearing member;

an intermediate transfer member on which the developer image on the image bearing member is transferred while the intermediate transfer member is moving at a predetermined surficial moving speed different from a surficial moving speed of the image bearing member; and control means for controlling the image forming means to cause it to form a predetermined image prior to formation of a normal image.

DESCRIPTION OF THE PREFERRED EMBODIMENTS

In the following, image forming apparatus according to the present invention will be more specifically described with reference to the accompanying drawings.

First Embodiment

Figure 3:
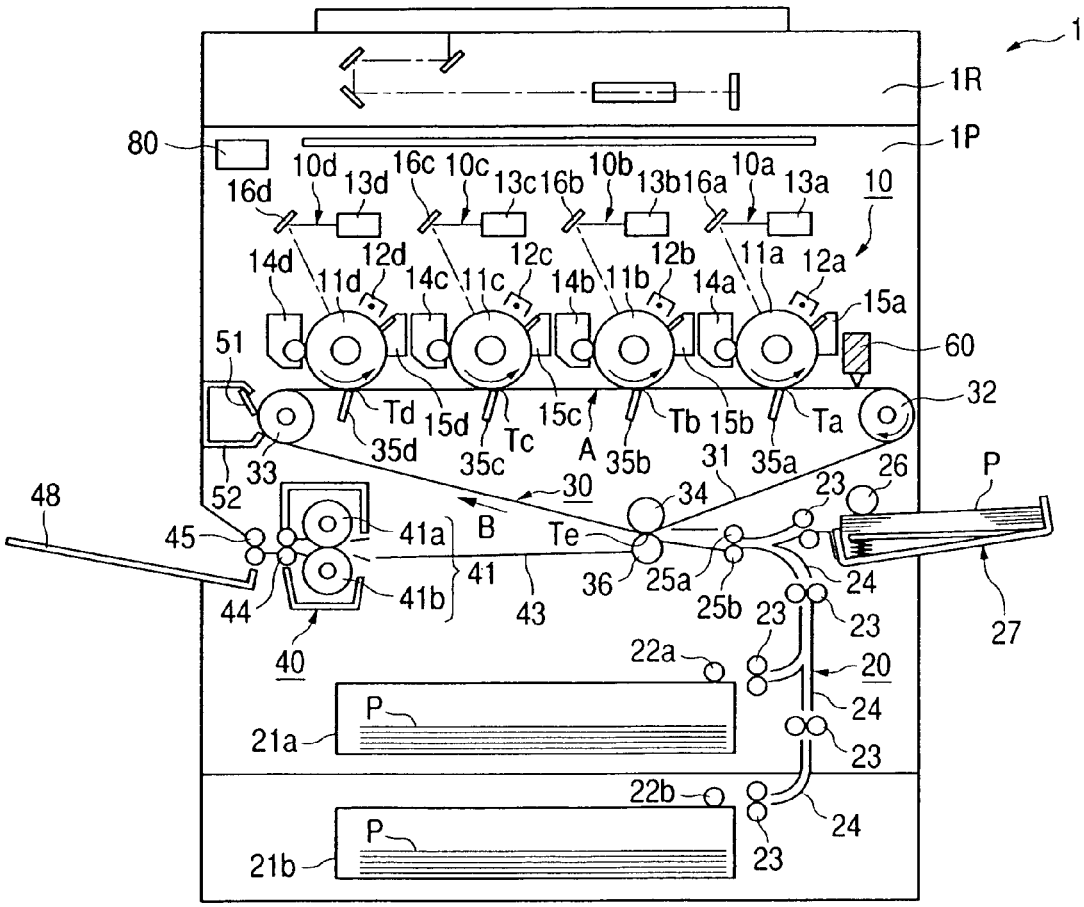
FIG. 3 is a drawing schematically showing the structure of an example of an image forming apparatus according to the present invention.

FIG. 3 is a drawing schematically showing a cross section of an image forming apparatus as an embodiment of the present invention. The image forming apparatus according to the first embodiment that will be described in the following is a color image outputting apparatus 1 utilizing an electrophotography process in which an image on an original is read by an optical system 1R, and an image is formed on a transferring material P in an image outputting portion 1P based on image information from the optical system 1R. In addition, the apparatus is provided with a plurality of image forming portions 10*a*, 10*b*, 10*c* and 10*d* arranged in series in the image outputting portion 1P, for which the present invention is considered to be especially effective. The apparatus has an intermediate transfer belt 31 serving as an intermediate transfer member and utilizes an intermediate transfer process.

The image outputting portion 1P is generally composed of an image forming portion 10 (including four stations 10*a*, 10*b*, 10*c* and 10*d* that are arranged in series and having the same structure), sheet feed unit 20, an intermediate transfer unit 30, a fixing unit 40 and a control portion 80.

In the following, each of the units will be specifically described. The structure of the image forming portion 10 is as follows. Photosensitive drums 11*a*, 11*b*, 11*c* and 11*d* are supported at their centers and driven to rotate in the directions indicated by arrows. Opposed to the outer peripheral surfaces of the photosensitive drums 11*a* to 11*d*, there is provided, along the rotation directions of the photosensitive drums 11*a* to 11*d*, primary chargers 12*a*, 12*b*, 12*c* and 12*d*, exposure portions 13*a*, 13*b*, 13*c* and 13*d* in the form of optical systems, a turn-back mirrors 16*a*, 16*b*, 16*c* and 16*d*, and developing apparatus 14*a*, 14*b*, 14*c* and 14*d*. In addition, in the downstream of the positions opposed to primary transfer charger 35*a*, 35*b*, 35*c* and 35*d* with an intermediate transfer belt 31 between, there is provided cleaning apparatus 15*a*, 15*b*, 15*c* and 15*d*.

The primary chargers 12*a* to 12*d* give charges to the surfaces of the photosensitive drums 11*a* to 11*d* with uniform charge amounts. Then, the photosensitive drums 11*a* to 11*d* are exposed by the exposure portions 13*a* to 13*d* with light beams such as laser beams that have been modulated in accordance with recording image signals via the turn-back mirrors, so that electrostatic latent images are formed on the photosensitive drums 11*a* to 11*d*.

Furthermore, the electrostatic latent images are visualized by the developing apparatus 14*a* to 14*d* accommodating developers (toners) of four colors (i.e., yellow, cyan, magenta and black) respectively. Thus, developed images (toner images) are formed as visible images.

At the positions of image transfer areas Ta, Tb, Tc and Td opposed to the primary transfer chargers 35*a* to 35*d*, the visualized toner images are sequentially transferred from the image forming portions 10*d*, 10*c*, 10*b* and 10*a* onto the intermediate transfer belt 31 that passes between the primary transfer chargers 35*a* to 35*d* and the photosensitive drums 11*a* to 11*d* in a superposed manner as the intermediate transfer belt advances.

As the photosensitive drums further rotate, and the toner remaining on the photosensitive drums 11*a* to 11*d* that has not been transferred onto the intermediate transfer belt 31 is scratched off by the cleaning apparatus 15*a*, 15*b*, 15*c* and 15*d* at positions downstream past the image forming areas Ta to Td, so that the surfaces of the photosensitive drums are cleaned. Image formations by the respective toners are sequentially performed in the above-described way.

The sheet feed unit 20 is composed of cassettes 21*a* and 21*b* for accommodating transferring materials P, a manual feed tray 27, pickup rollers 22*a*, 22*b* and 26 for picking up transferring materials P one by one out of the cassettes 21*a* or 21*b* or the manual feed tray 27, paired feed rollers 23 and feed guides 24 for conveying transferring materials P picked up by the pickup rollers 22*a*, 22*b* or 26 to registration rollers 25*a* and 25*b* and the registration rollers 25*a* and 25*b* for delivering transferring materials to a secondary transfer area Te in synchronization with image formation timing of the image forming portions 10*a* to 10*d*.

Next, the intermediate transfer unit 30 including the intermediate transfer belt 31 will be specifically described. The intermediate transfer belt 31 is looped around a driving roller 32 for transmitting drive to the intermediate transfer belt 31, a driven roller 33 that is driven by rotation of the intermediate transfer belt 31 and a secondary transfer opposed roller 34 opposed to the secondary transfer area Te with the belt 31 between, which rollers serves as looped rollers. A primary transfer plane A is formed between the driving roller 32 and the driven roller 33 among these rollers. The driving roller 32 has a rubber coating (made of urethane or chloroprene) having a thickness of several millimeters formed on the surface of a metal roller, so that slippage between the driving roller 32 and the belt 31 is avoided. The driving roller 32 utilizes a pulse motor (not shown) to rotationally drive the intermediate transfer belt 31 in the direction indicated by arrow B that agrees with the rotation of the photosensitive drums 11*a* to 11*d*

The primary transfer plane A is opposed to each of the image forming portions 10*a* to 10*d*, and each of the photosensitive drums 11*a* to 11*d* is arranged to be opposed to the primary transfer plane A of the intermediate transfer belt 31. Consequently, the primary transfer areas Ta to Td are disposed on the primary transfer plane A. In the primary transfer areas Ta to Td at which photosensitive drums 11*a*to 11*d* and the intermediate transfer belt 31 are opposed to each other, there is provided primary transfer chargers 35*a* to 35*d* disposed on the backside of the intermediate transfer belt 31.

A secondary transfer roller 36 serving as secondary transferring means is disposed at a position opposed to the secondary transfer opposed roller 34, so that the secondary transfer area Te is formed as a nip between the secondary transfer roller 36 and the intermediate transfer belt 31.

At a position downstream of the secondary transfer area Te on the intermediate transfer belt 31, there is provided a cleaning blade 51 for cleaning the image forming surface of the intermediate transfer belt 31 and a waste toner box 52 for receiving waste toner.

The fixing unit 40 is composed of a fixing roller 41*a* having a heat source such as a halogen heater accommodated in the interior thereof, a pressure roller 41*b* (which may also be provided with a heat source) pressed against the fixing roller 41*a*, a guide 43 for guiding transferring material P to the nip of the aforementioned paired rollers 41, internal discharge rollers 44 for further guiding the transferring material having been discharged from the paired rollers 41 to the exterior of the apparatus and external discharge rollers 44.

The control portion 80 is composed of a CPU (not shown) for controlling operations of the mechanisms equipped in the above-described units, a control board and motor drive board (not shown) etc. When a image forming operation start signal is emitted from the control portion 80, feeding of a transferring material P from a sheet feeder selected in accordance with, for example, the sheet size is started.

In the following, operations of the apparatus will be described.

When the image forming operation start signal is emitted from the control portion 80, a transferring material P is individually picked up by the pickup roller 22*a*, 22*b* or 26 out of the cassette 21*a*, cassette 21*b* or the manual feed tray 27. The transferring material P is guided between sheet feed guides 24 by the paired feed rollers 23 so as to be conveyed to the registration rollers 25*a* and 25*b*. At that time, the registration rollers 25*a* and 25*b* are at rest, and the leading edge of the transferring material P impinges on their nip portion. After that, the registration rollers 25*a* and 25*b* are started to rotate in synchronization with the start timing of image formation by the image forming portions 10*a* to 10*d*. The rotation timing of the registration rollers 25*a* and 25*b* is set so that the transferring material P and the toner image having been primarily transferred onto the intermediate transfer belt 31 just agree with each other in the secondary transfer area Te.

On the other hand, in the image forming portion 10, upon emission of the image forming operation start signal from the control portion 80, a toner image (or developed image) that has been formed, in accordance with the above-described process, on the most upstream photosensitive drum 11*d* with respect to the moving direction (or rotating direction) B of the intermediate transfer belt 31 is primarily transferred in the primary transfer area Td onto the intermediate transfer belt 31 by the aid of the primary transfer charger 35*d* to which a high voltage is applied.

The primarily-transferred toner image is conveyed to the next primary transfer area Tc. In that area, the image formation has been performed with a delay corresponding to the time required for conveying the toner image between adjacent image forming portions 10, and the next toner image is transferred over the previous toners with their registrations (i.e., image positions) being aligned. The same processes are repeated in the primary transfer areas Ta and Tb for the other colors. Thus, toner images of four colors are primarily transferred sequentially onto the intermediate transfer belt 31 in a superposed manner as the intermediate transfer belt 31 moves.

After that, the transferring material P enters the secondary transfer area Te to abut the intermediate transfer belt 31. Then, a high voltage is applied to the secondary transfer roller 36 in synchronism with the passing timing of the transferring material P. Then, the composite toner image, which has been formed on the intermediate transfer belt and in which four colors are superposed, is transferred onto the surface of the transferring material P at one time.

After that, the transferring material P is precisely guided to the nip portion of the paired fixing rollers 41 by the conveying guide 43. The toner image is fixed on the surface of the transferring material by heat and pressure applied by the paired fixing rollers 41. After that, the transferring material P is conveyed by the internal discharge rollers 44 and the external discharge rollers 45 so as to be discharged to the exterior 48 of the apparatus.

In this type of image forming apparatus, in order to correct registration errors (i.e., out of color registration or misregister) of the color images formed on the respective photosensitive drums 11*a* to 11*d*, a register sensor 60 for detecting misregister is provided at a position on the primary transfer plane A downstream of all of the image forming portions 10*a* to 10*d* and before the position at which the belt 31 is turned by the driving roller 32. The aforementioned registration error can be generated by a mechanical mounting error among the photosensitive drums 11*a* to 11*d*, an optical path length error of the laser beam light or a variation in the optical paths in the exposure portions 13*a* to 13*d* or a warp of the LED caused by the environmental temperature.

In the following, the operation for correcting misregister will be described with reference to FIG. 4.

Since the structures of the image forming portions 10*a*, 10*b*, 10*c* and 10*d* are the same, the parts in the image forming portions will be designated in a manner like "the photosensitive drum 11" or "the exposure portion 13," etc. In other words, the term "photosensitive drum 11" will be used for referring to all of the photosensitive drums 11*a* to 11*d* collectively.

Figure 4:
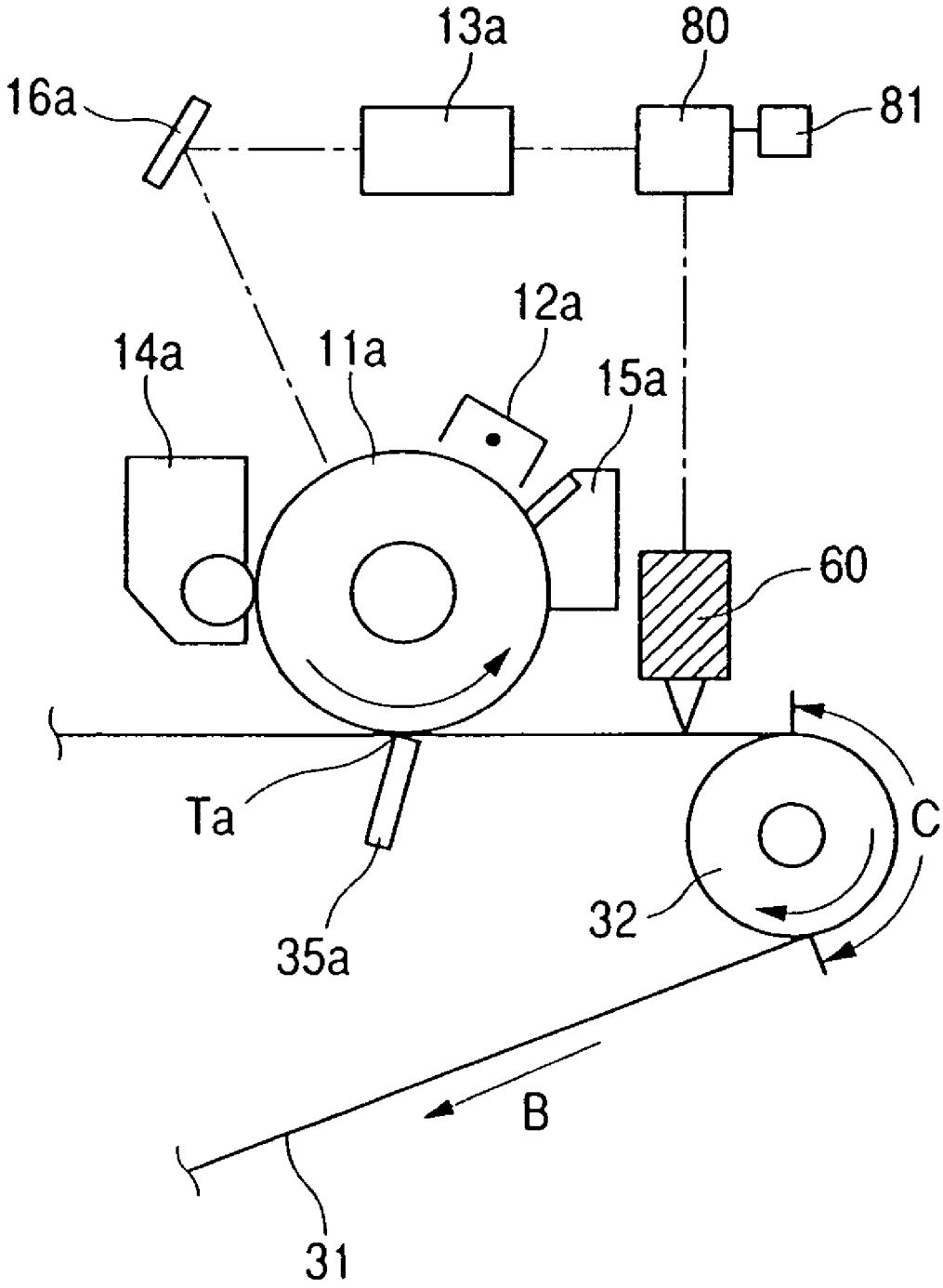
FIG. 4 is a drawing schematically showing the structure of an example of a mechanism for detecting out of color registration.

FIG. 4 is a drawing schematically showing a portion around the register sensor 60 serving as a misregister detection means for detecting registration correcting patterns (or misregister detecting images) of the image forming apparatus 1. The register sensor 60 includes an LED serving as a light emitting member and a photodiode serving as a light receiving member.

Registration correcting pattern images (i.e., misregister detecting images) formed on the intermediate transfer belt 31 by the photosensitive drums 11*a* to 11*d* in response to a signal from a registration correcting pattern generating portion 81 in the control portion 80 are read by the register sensor (detection means) 60 serving as misregister detection means composed of a light emitting element and a light receiving element, so that out of color registrations, i.e., registration errors (or misregisters) on the photosensitive drums 11*a* to 11*d* corresponding to the respective colors are detected. The control portion 80 functions as a misregister correcting means to make an electrical correction on an image signal to be recorded or to correct variations in the optical path lengths or variations in the optical paths by driving the turn-back mirrors 5*a* to 5*d* provided in the optical paths of the laser beams.

The intermediate transfer belt 31 is an endless belt made of an elastic member such as a rubber or an elastomer having a circumferential Young's modulus equal to or more than $10^7$ Pa. A preferable thickness of the intermediate transfer belt 31 is 0.3 to 3 mm from the viewpoint of ensuring strength and precision in the thickness and realizing flexible rotary drive. Furthermore, the intermediate transfer belt 31 is controlled to have a desired electric resistance (preferably, a volume resistance equal to or less than $10^{11}$ Ω cm) with addition of a conductive material such as a metal powder (e.g., carbon powder). The intermediate transfer belt is looped around the driving roller 32 disposed downstream of the image forming portions 10, the driven roller 33 and the secondary transfer opposed roller 34 so as to be driven in the direction indicated by the arrow B. The portion of the intermediate transfer belt 31 that is engaging on the driving roller 32 disposed downstream of the primary transfer plane A with respect to the above mentioned movement of the intermediate transfer belt 31 is referred to as area C.

In order to improve the transfer latitude upon transferring from the photosensitive drums 11*a* to 11*d* onto the intermediate transfer belt 31, a peripheral speed difference is given between drums 11*d*, 11*c*, 11*b*, and 11*a* and the intermediate transfer belt 31, so that the rotation speed of the intermediate transfer belt 31 is higher than that of the drums 11*d*, 11*c*, 11*b* and 11*a* by several percents.

According to the present invention, in this type of image forming apparatus in which a peripheral speed difference is given between the image bearing members and the intermediate transfer belt, a predetermined image that has been designed in advance is formed on the intermediate transfer member before normal print image forming operations. In the specification of the present application, the predetermined image is referred to as "an additional image."

The following description will be made with reference to the timing chart upon forming the additional image presented as FIG. 2.

Figure 2:
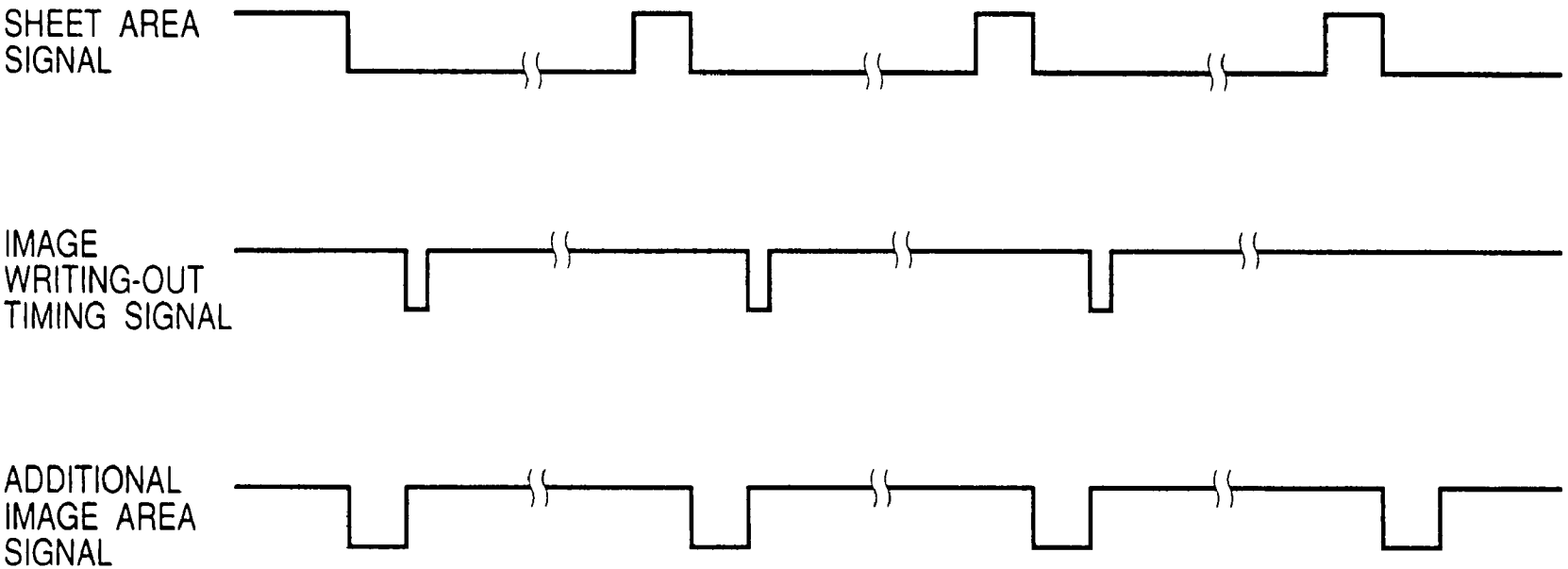
FIG. 2 is a timing chart of an example of an image forming operation according to the present invention.

In FIG. 2, the "sheet area signal" is a signal indicative of a sheet area in the sub-scanning direction corresponding to the size of the transferring material in the form of a sheet, in other words, a signal generated during a transferring material area (or a sheet area) on the intermediate transfer belt 31 passes through the transfer area. The "image writing-out timing signal" is a timing signal for actually starting normal print image formation. The "additional image area signal" is an image area signal for forming a predetermined image (i.e., an additional image) that has been designed in advance according to the present invention on the intermediate transfer belt 31. Formation of the additional image is performed before formation of a normal print image, as will be seen from FIG. 2.

Here, the direction in which scanning with the laser beam is performed, or the direction transverse to the direction of movement of the transferring belt 31 is referred to as the main scanning direction, while the direction of movement of the photosensitive drums 11 and the transferring belt 31 is referred to as the sub-scanning direction.

Figure 1:
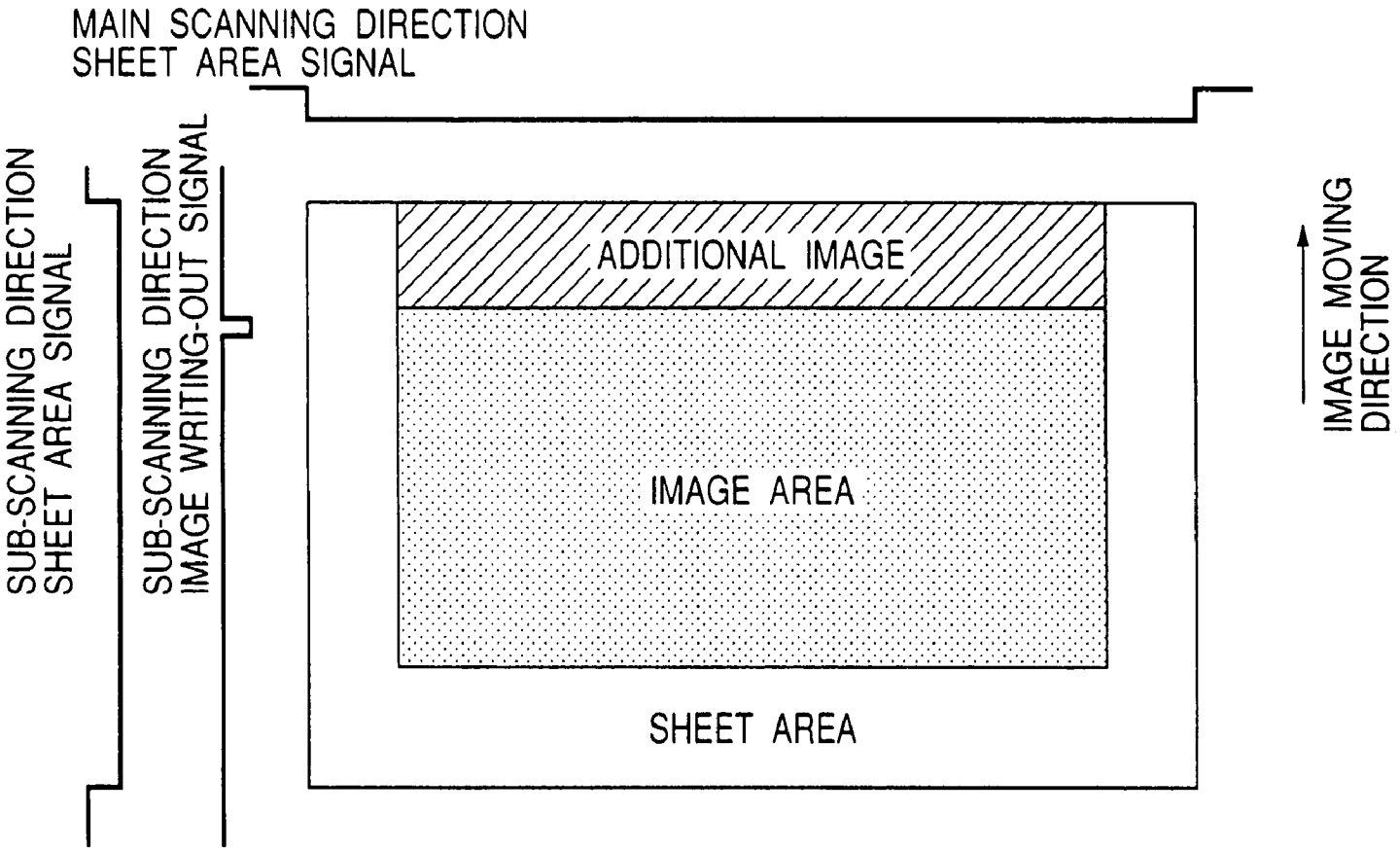
FIG. 1 is a front view showing an example of a normal print image and an additional image according to the present invention.

As shown in FIG. 2, the image writing out timing signal is emitted after the sheet area signal is emitted. Thus, as shown in FIG. 1, an additional image is formed in the sheet area of a transferring material at a position adjacent to and upstream of (with respect to the intermediate transfer belt moving direction) a normal print image (i.e., an image area) in the form of a composite toner image in which four color images are superposed and which has been formed in the sheet area by the above-described process.

As per the above, according to the present invention, a predetermined additional image is formed on the intermediate transfer belt 31 before normal print images on the photosensitive drums 11 are transferred. In this embodiment, as shown in FIG. 2 as the "additional image area signal," an image area signal for forming a predetermined image that has been designed in advance on the transferring belt 31 is emitted before an image writing-out timing signal is emitted, that is, before a normal image is formed. This additional image is not transferred onto the transferring material P by virtue of an appropriate arrangement of the operation timing of the secondary transfer roller 36.

In the following, a more detailed description will be made under the assumption that a full color image is to be formed. In this embodiment, a yellow image is formed in the first image forming portion 10*d* and magenta, cyan and black images are sequentially formed in the succeeding image forming portions 10*c*, 10*b* and 10*a* respectively. These images are transferred onto the intermediate transfer member in a superposed manner, so that a color image is formed. First, in the image forming portion 10*d*, a low density image (for example, an image composed of small dots) serving as the additional image is formed in an area of the photosensitive drum 11*d* that precedes the image area, and subsequently a normal image is formed. After that, these images are transferred onto the intermediate transfer belt 31 under the state as shown in FIG. 1. In this process, since the normal image formed by the image forming portion 10*d* enters the primary transfer portion Td between the intermediate transfer belt and the photosensitive drum after the additional image first enters that portion Td, a variation in the frictional force upon entering the portion Td can be reduced as compared in the case that the normal image enters the primary transfer portion Td directly.

The yellow image that has been transferred onto the intermediate transfer belt while accompanied by the additional image is then conveyed to the downstream image forming portion 10*c* with the additional image on the leading side, and a normal image formed by the image forming portion 10*c* is transferred in such a way as to be in alignment with the image area. In this process, an additional image need not be formed in the image forming portion 10*c*. In the primary transfer portion Tc of the image forming portion 10*c*, a variation in the frictional force is also reduced, since the yellow additional image enters it first. In the succeeding image forming portions 10*b* and 10*a* disposed in the downstream, operations similar to that in the image forming portion 10*c* is performed and similar effects are realized.

As per the above, in this embodiment, the additional image is formed, before formation of a normal print image, on the intermediate transfer belt 31 at a position upstream of the normal print image area with respect to the moving direction of the belt 31. As shown in FIG. 1, there is no gap between the image area and the additional image area formed in the upstream side of the image area with respect to the moving direction of the intermediate transfer belt 31. It is preferable that the additional image be formed in contact with the normal print image in this way. However, so long as the additional image is present within the transferring material area (i.e., within the sheet area), a variation in the coefficient of friction can be reduced, since toner is present between the transferring belt 31 and the photosensitive drums 11*a* to 11*d* before the normal print images are transferred.

As has been described in the description of the related background art, in the case that there is a peripheral speed difference between the photosensitive drums 11*a* to 11*d* and the intermediate transfer belt 31, frictional forces are generated between them. In addition, the coefficient of friction varies depending on presence/absence of toner between the photosensitive drums 11*a* to 11*d* and the intermediate transfer belt 31, and therefore the rotation speeds of the photosensitive drums 11*a* to 11*d* vary. As a result, image exposure on the photosensitive drums is blurred, and streaked images are sometimes generated at the leading edge portions of images.

The generation of streaked images at the leading edge portion of an image implies that the speed of a photosensitive drum tends to vary to cause blur at the image writing-out position at which the area passing through the transfer area changes from a non-image area to an image area or at which the state changes abruptly from a state in which toner is not present between the photosensitive drum and the transferring belt to a state in which toner is present between them.

In the case that a predetermined image in the form of an additional image is formed on the transferring belt in advance before the transferring of a toner image formed on the photosensitive drum 11, toner is present between the transferring belt and the photosensitive drum at the time at which the sheet area enters the transfer area and thereafter. Consequently, the situation that the state changes abruptly from a state in which toner is not present to a state in which toner is present upon entering the image area is avoided, so that a change in the speed of the drum can be reduced. Therefore, stable image formation is realized and it is possible to provide an image forming apparatus that can print high quality images.

Since the additional image is formed before formation of the normal print image, in the case that a plurality of image forming portions are provided, it is preferable that formation of the additional image is performed by the first image forming portion that is disposed most upstream with respect to the transferring belt moving direction and by which the toner image that is formed first is transferred.

Since the additional image per se is not an intended print image, it is preferable that the additional image be formed by the station for forming yellow images that are of low visibility.

When a monochrome image is to be formed in the apparatus like this embodiment that is provided with a plurality of image forming portions, image formation is performed only by the image forming apparatus 10*a* for forming black images. In this case, formation of an additional image in yellow by the image forming apparatus 10*d* that is performed upon full color image formation is not performed, but an additional image in black is formed by the image forming portion 10*a* before formation of a normal image.

Second Embodiment

As described in the description of the first embodiment, in the image forming apparatus in which a peripheral speed difference is set between the rotation speed of a plurality of image forming portions and the rotation speed of a transferring means onto which toner images are to be transferred, in order to prevent a variation in the coefficient of friction between the transferring belt and the photosensitive drum and a variation in the rotation speed of the photosensitive drum or the transferring belt caused by the variation in the coefficient of friction, an additional image in the form of a predetermined image designed in advance is formed on the intermediate transfer belt at a position upstream, with respect to the transferring belt moving direction, of the area of a normal print image that is formed based on normal image information. Thus, image formation can be performed with improved stability and printing of high quality images can be made possible.

However, in the above-described image forming apparatus, in the case that the additional image is output as a fully uniform image such as a solid image or a halftone image, the radiation noise level will be increased. Furthermore, in the case that the additional image is output as a longitudinal line image in order to reduce such a radiation noise, longitudinal line streaked contamination will be generated on the secondary transfer roller.

In other words, in the above-described image forming apparatus, in the case that dots are formed at an always fixed main scanning position, there are problems that longitudinal streaked contamination is generated on the secondary transfer roller, toner accumulates at a specific position on the cleaning blade, or the dot toner image transferred on a transferring material becomes significantly visible.

Therefore, it is preferable that the additional image includes toner images of small areas with a unit area formed by one dot or a plurality of dots (those toner images will be referred to as dot developed images (or dot toner images)) that are dispersed with respect to the main scanning direction.

The additional image can be formed with the aforementioned dot toner images being dispersed by dividing or comparting the image area into dot areas each of which is dimensioned to extend by m dots in the direction (i.e., the main scanning direction) transverse to the moving direction of the transferring belt 31 and n dots in the moving direction of the transferring belt 31 (i.e., the sub-scanning direction) and forming a toner image(s) in one of the dot areas or in a plurality of dot areas.

In view of the above, in this embodiment, an image formed in the following way will be used as the additional image.

In this embodiment, the first image forming portion 10*d* disposed most upstream in the primary transfer plane A is the yellow station for forming images with yellow toner, and small dot toner images serving as the additional image are formed in a manner superposed on the image formed on the intermediate transfer belt 31 by the yellow station.

This is because when the dot toner images are added to the image formed by the most upstream first image forming portion 10*d*, the dot toner images will function to reduce a variation in the coefficient of friction upon primary transferring in all of the stations disposed in the downstream. In addition, visibility of yellow dots is lower than that of the other dots (i.e., magenta, cyan and black dots) when they are transferred onto a transferring material P.

Figure 6:
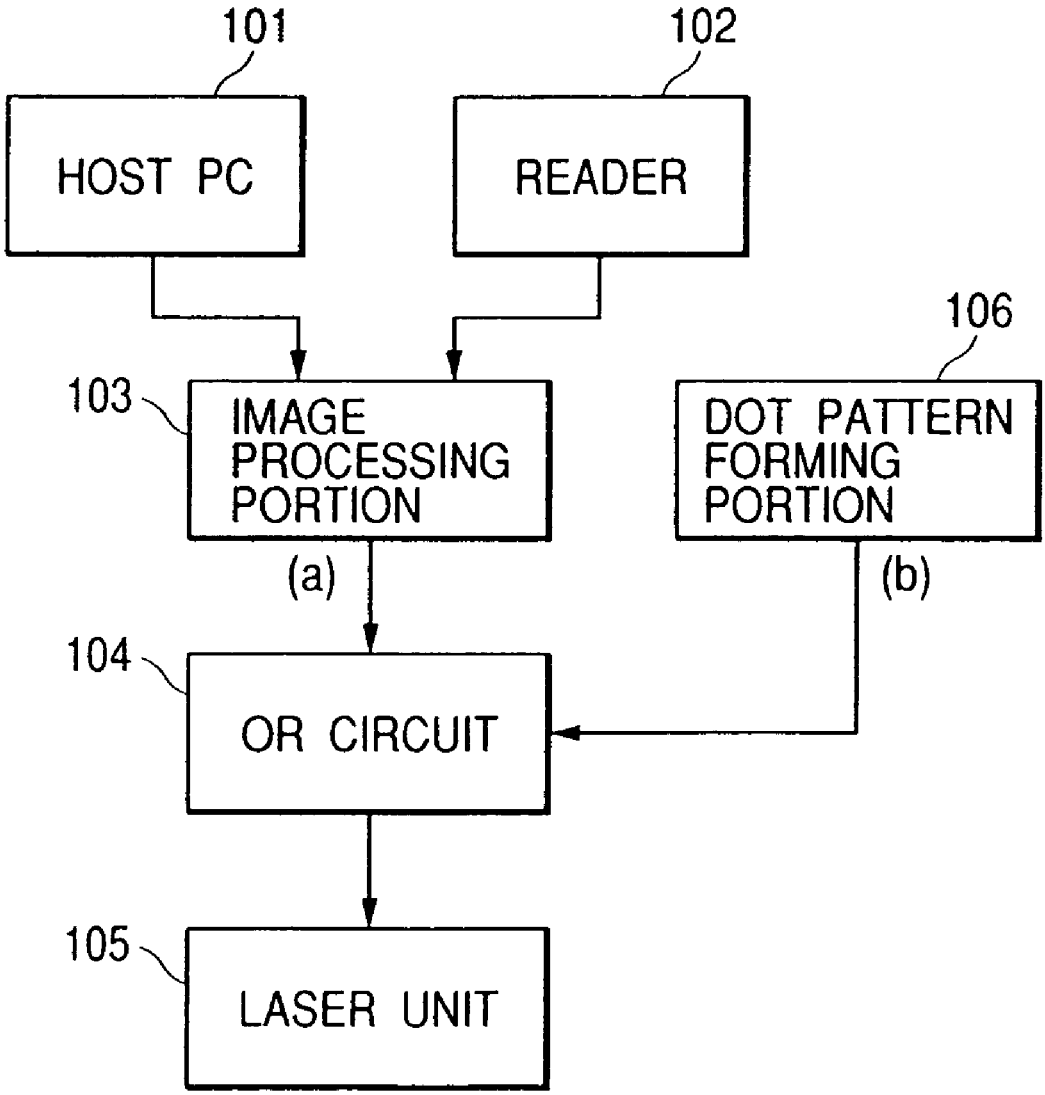
FIG. 6 is a block diagram showing an example of a control circuit for performing additional image formation according to the present invention.

Image data to be input to the exposure portion 13*d* is generated in accordance with a control process shown in the block diagram of FIG. 6.

Image information input from a host PC 101 or a reader (i.e., an image reading portion) 102 is processed by an image processing portion 103 and output as an image signal (a) for driving a laser unit 105 acting on the exposure portions 13*a* to 13*d*. In a dot pattern forming portion 106, there is generated a dot pattern signal (b) for forming a dot pattern in which small dot toner images are dispersed to form an additional image that constitutes a characterizing feature of the present invention.

The image signal (a) and the dot pattern signal (b) are subjected to the logical OR operation in an OR-circuit 104 and input to the laser unit 105. In other words, the image signal (a) and the dot pattern signal (b) are summed in the OR-circuit. As a result, the additional image formed on the photosensitive drum 11*d* will be a combination of the image information and the small dot pattern. In this case also, the dot pattern is formed in the additional image area shown in FIG. 1 in the upstream of the normal print image forming area with respect to the moving direction of the intermediate transfer belt 31.

The process in the dot pattern forming portion 106 will be described with reference to FIGS. 7 and 8.

Figure 7:
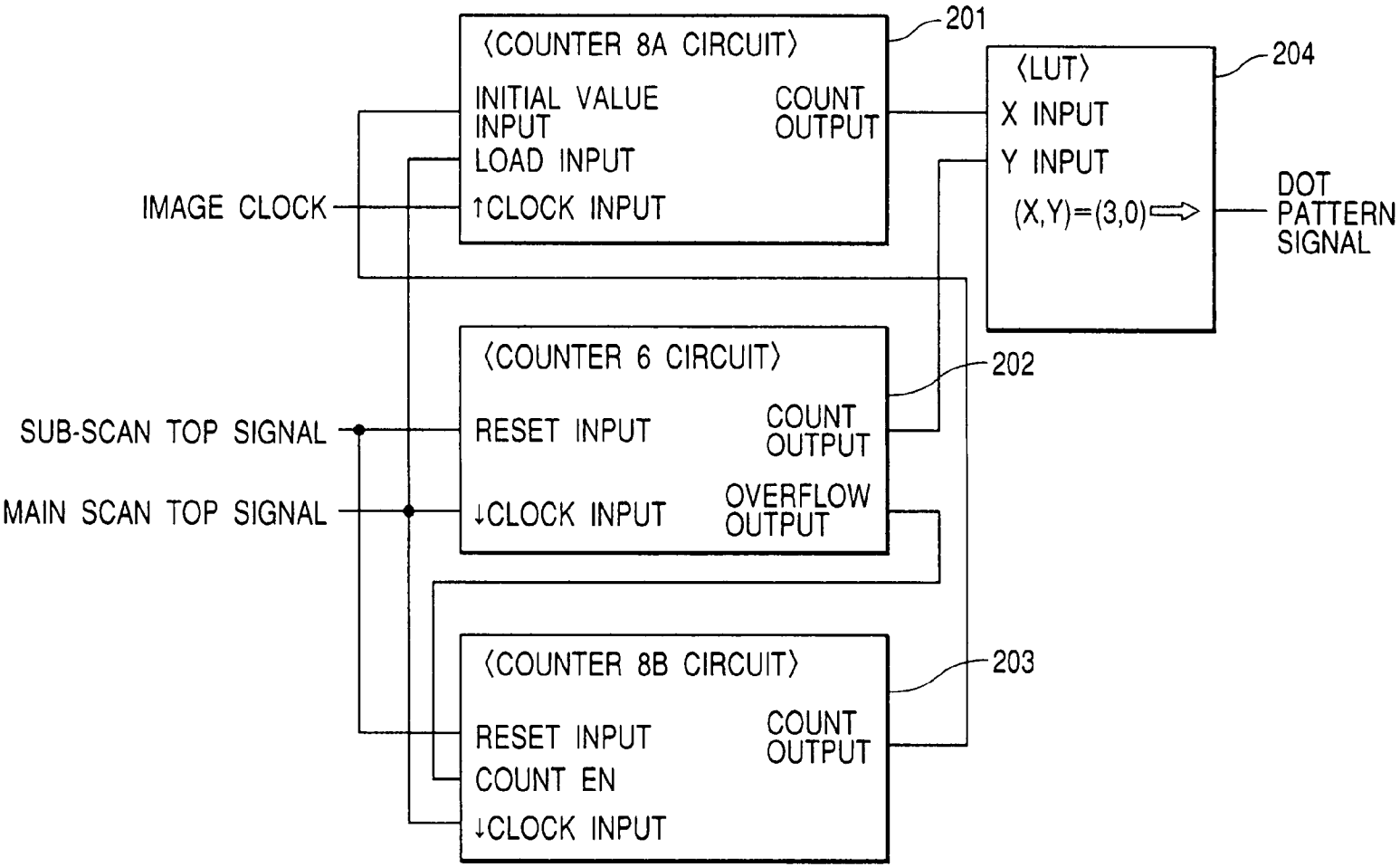
FIG. 7 is a block diagram showing an example of a control circuit for performing additional image formation according to the present invention.
Figure 8:
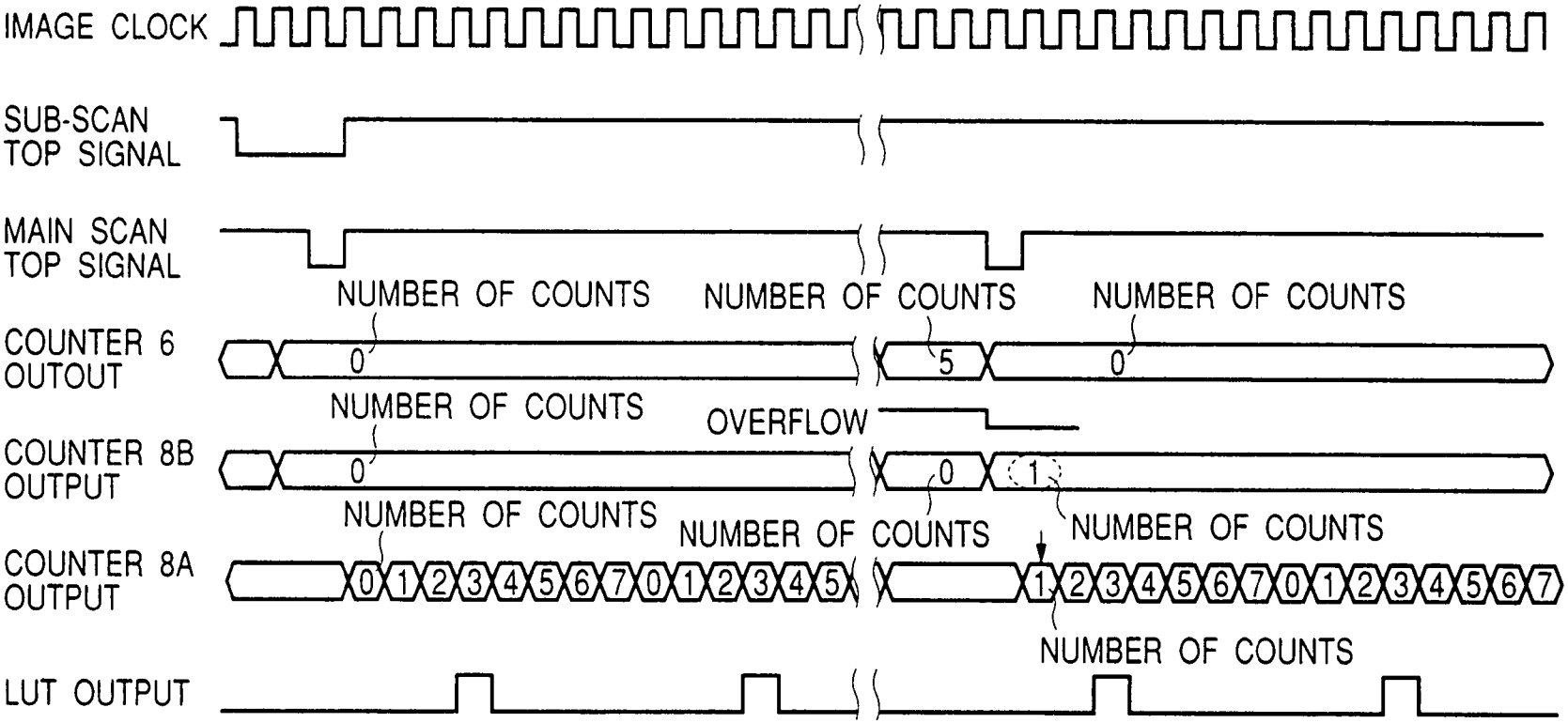
FIG. 8 is a diagram illustrating an example of an additional image forming method according to the present invention.

As shown in FIG. 7, the dot pattern forming portion 106 is composed of a counter 8A circuit 201, a counter 6 circuit 202, a counter 8*b* circuit 203 and an LUT 204.

As an example, it is assumed that the number of dots m in the main scanning direction X of a small dot area included in the dot pattern is 8, the number of dots n in the sub-scanning direction Y of a dot area is 6 and the number of shift dots k is 1. In addition, in this embodiment, the number of dots included in a dot toner image formed in a dot area is only one, and that dot is at the position represented by (main scanning direction X, sub-scanning direction Y)=(3, 0) within the dot area.

In the following, operations of the dot pattern forming portion 106 will be described with reference to FIG. 8.

The counter 8A circuit 201 is to count the position in the main scanning direction X with the number of counts m=8. The counter 8A circuit 201 repeats counting from 0 to 7 that corresponds to one section of the dot areas while using an image clock as a clock input to divide the main scanning direction of the additional image formation area into dot areas.

The counter 8A circuit 202 is adapted to be loaded with an initial value as the count of the leading edge position in the main scanning direction of the additional image area while using an output of the counter 8B circuit 203 as the initial value and using a main scan top signal as a load signal. Here, since the initial value of the counter 8B circuit 203 is 0, the counter 8A circuit 201 counts the leading edge portion in the main scanning direction as 0 and repeats counting from 0 to 7 until reaching the trailing edge in the main scanning direction of the dot pattern.

The counter 6 circuit 202 is a counter for counting up (or incrementing the count) while using the main scan top signal as a clock. The counter 6 circuit 202 repeats counting from 0 to 5. In other words, the counter 6 circuit 202 increments the count by 1 (one) every time counting in the main scanning direction by the counter 8A circuit 202 is completed. Thus, the counter 6 circuit 202 performs counting in the sub-scanning direction with n=6.

The counter 8B circuit 203 is a counter for counting the initial value upon shift. The counter 8B circuit 203 increments the count every time the counter 6 circuit 202 complete counting from 0 to 5 in the sub-scanning direction to return to 0, namely every time it overflows, and when the main scan top signal is input, the count value of the counter 8B circuit 203 is loaded to the counter 8A circuit 201. In other words, the counter 8B circuit 203 increments the count by 1 (one) every time the counter 8A circuit 201 performs counting from edge to edge of the dot pattern in the main scanning direction six times. Thus, the initial count number of the counter 8A circuit 201 upon loading of the main scan top signal is incremented by 1. Specifically, in the case that the initial count value is 0, it is changed to 1 and the counting starts with 1 and proceeds as 2, 3, 4, . . . .

The count value of the counter 8A and the count value of the counter 6 are input to the LUT 204. When the combination of those values coincides with a value set in the LUT, the output of the LUT becomes "H," so that a small dot toner image is formed. In this embodiment, an dot toner image is formed at a position (X, Y)=(3, 0), which corresponds to the case in which the counter 8A circuit 201 counts 3 and the counter 6 circuit 202 counts 0.

Figure 5:
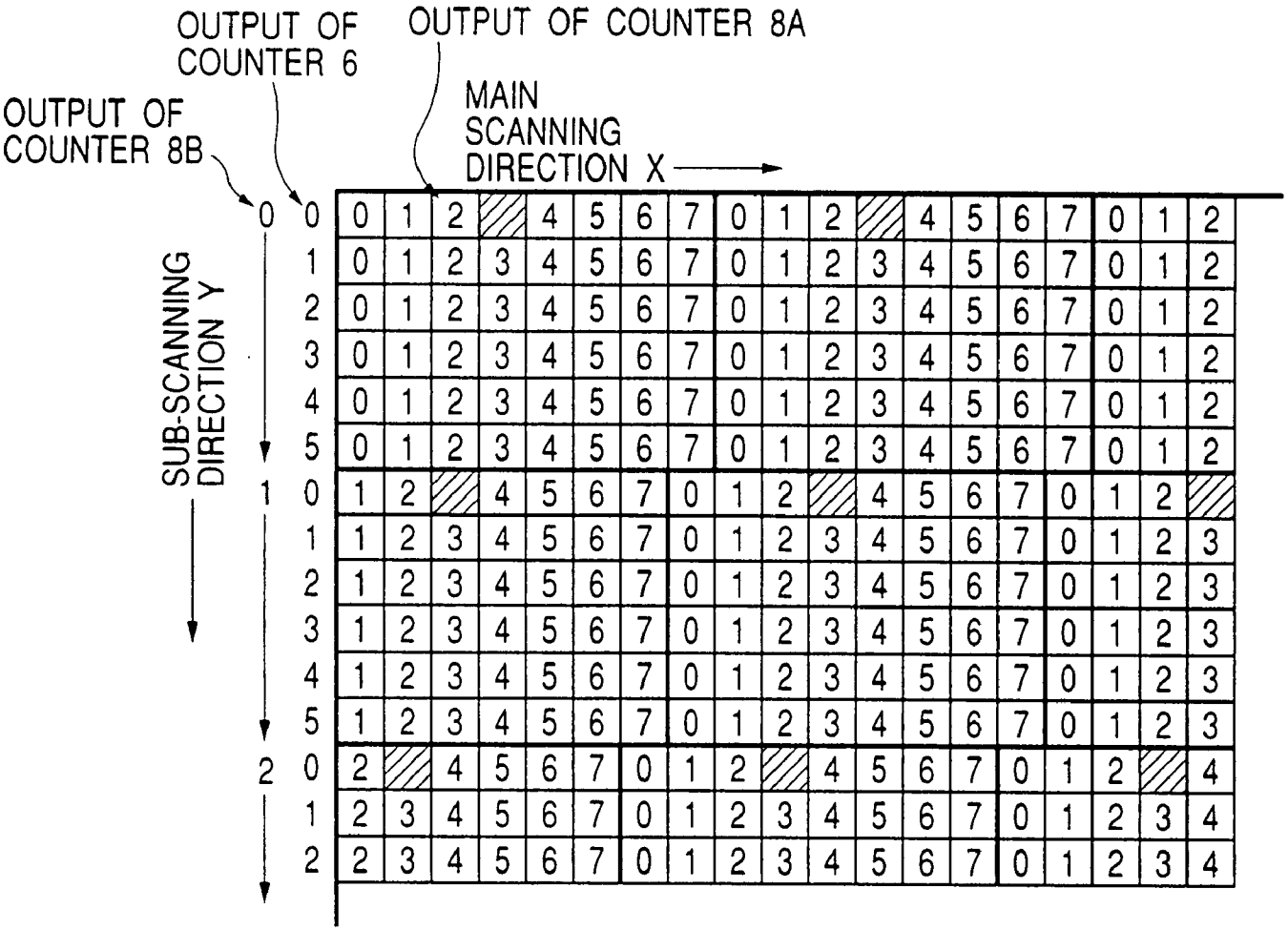
FIG. 5 is a diagram illustrating an example of an additional image forming method according to the present invention.

With the above-described operations of the dot pattern forming portion, a small dot pattern as shown in FIG. 5 is formed. In FIG. 5, each of the small squares is a pixel (i.e., a dot), and dot toner images of the dot pattern are formed in the pixels designated with hatching in FIG. 5.

Since the counter 8A circuit 201 counts in the main scanning direction using as the initial value the count value of the counter 8B circuit 203 that increments the count every time the count in the sub-scanning direction is performed six times, the position which is counted as 3 and at which a dot toner image is formed shifts in the main scanning direction by the shift dot number k=1 as the count in the sub-scanning direction is incremented.

Since the position in the main scanning direction of the dot toner image is shifted, every six main scanning lines, in the direction reverse to the main scanning direction by the shift dot number k=1, the distribution in the main scanning direction of the positions at which dot toner images are formed becomes uniform. Consequently, it is possible to eliminate the problems that longitudinal streaked contamination is generated on the secondary transfer roller, toner accumulates at a specific position on the cleaning blade, or the dot toner image transferred on a transferring material becomes significantly visible.

While in this embodiment, the shift dot number k is set to 1 (one), in the case that the size m of the dot area in the main scanning direction is 8, the shift dot number k may be set in such a way that the greatest common divisor of m and k is 1, namely the shift dot number k may be 3, 5 or 7. With these values also, distribution in the main scanning direction of the positions at which dot toner images are formed can be made uniform.

In the additional image formed in the above-described manner, the dot toner images are gradually shifted in the main scanning direction as seen along the sub-scanning direction. In other words, slanted line images are formed in the image as a whole. From this follows that when a slanted line image is formed as an additional image, it is not likely that dots are formed at a fixed position with respect to the main scanning direction. Therefore, a slanted line image is preferable as an additional image.

As described before, since the additional image thus formed is present in the upstream of a normal print image within the transferring material area and in contact with the normal print image, even when there is a peripheral speed difference between the drum and the intermediate transfer belt, a variation in the coefficient of friction due to presence/absence of toner between the drum and the transferring belt and a variation in the rotation speed of the drum can be prevented, so that generation of streaked images at the leading edge portion of an image due to blur in image exposure of the drum is avoided. In addition, it is possible to provide an image forming apparatus that is capable of printing high quality images with improved stability in image formation without an increase in the radiation noise level and that does not cause longitudinal line streaked contamination on the secondary transfer roller.

Even in the apparatus in which a peripheral speed difference is not set between an image bearing member and transferring means, an unintended speed difference can occur due to eccentricity of a driving roller or other reasons, so that out of color registration can be generated. In such an image forming apparatus also, stability of image formation can be improved by forming predetermined dot toner images including small dots dispersed on the transferring means in addition to normal image information, so that printing of high quality images is made possible.

Third Embodiment

In the image forming apparatus according to the first and second embodiments, an additional image is formed before formation of a normal print image in order to prevent a variation in the coefficient of friction between the intermediate transfer belt 31 and the photosensitive drums 11*a* to 11*d* that is caused by presence/absence of toner between those members. In this third embodiment, a description will be made of an image forming apparatus having the same structure in which an additional image is formed before normal print image formation and at another timing additionally.

Figure 10:
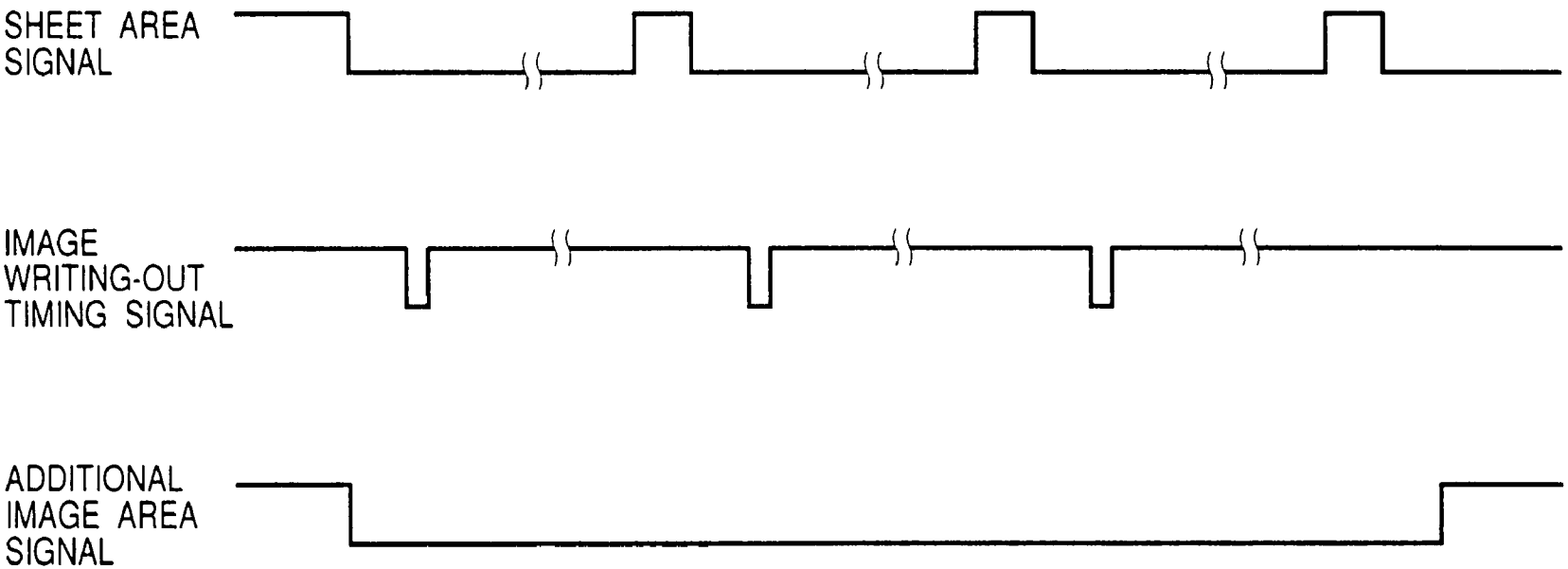
FIG. 10 is a timing chart of another example of an image forming operation according to the present invention.

FIG. 10 is a timing chart of formation of vibration prevention image in this embodiment.

Similar to the first embodiment, a predetermined additional image is formed on the intermediate transfer member before formation of a normal print image. Similar to FIG. 2, in FIG. 10 also, the "sheet area signal" is a signal indicative of a sheet area in the sub-scanning direction corresponding to the sheet size of the transferring material, and the "image writing-out timing signal" is a timing signal for actually starting normal print image formation. The "additional image area signal" is an image area signal for forming a predetermined image (i.e., an additional image) according to the present invention. Formation of the predetermined image that has been designed in advance is performed before formation of a normal print image, as will be seen from FIG. 10.

In addition, in this embodiment, upon consecutive printing on N transferring materials, the additional image is continuously formed from the time at which the first image area starts to the time at which at which the N-th image area ends, wherein in the normal print images areas, composite images of additional images and normal print images are formed.

Figure 9:
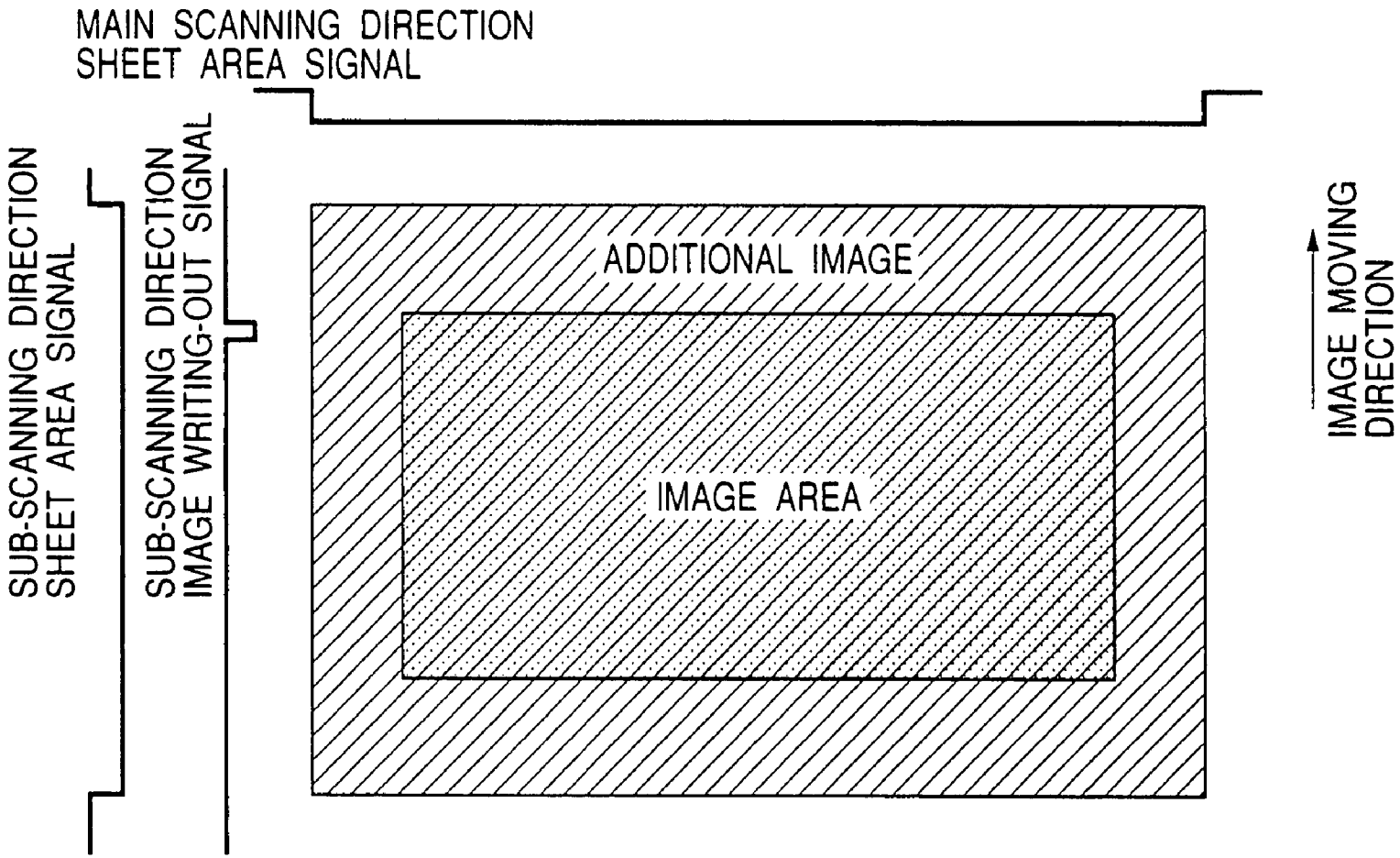
FIG. 9 is a front view showing another example of a normal print image and an additional image according to the present invention.

The additional image formed by the above-mentioned timing is shown in FIG. 9.

In FIG. 9, the hatched area that is present within the sheet area and outside the image area is the additional image area that characterizes the present invention. The additional image is an image drawn as slanted lines. In FIG. 9, the additional image is formed in the sheet area shown in FIG. 1.

The dotted area surrounded by the additional image area is the normal print image area, in which an image is formed in accordance with a sub-scanning direction image writing-out signal. In this case, the additional image is formed in a superposed manner over the normal print image in the normal print image area.

With this feature, a gap between the normal print image and the additional image area disposed on the upstream side thereof with respect to the moving direction of the intermediate transfer belt is eliminated, and therefore it is possible to prevent a variation in the coefficient of friction due to the shift at the transferring nip from the portion in which toner is not present to the portion in which toner is present.

According to another method, the additional image may be formed at the leading and trailing edge portions outside the normal print image area within the transferring material area without being superposed on the normal print image.

With this feature, a significant variation in the coefficient of friction between the drum and the intermediate transfer belt due to a peripheral speed difference between those members can be prevented, so that generation of streaked images at the leading edge portion of an image can be avoided. Thus, an image forming apparatus capable of printing high quality images with an improved stability in image formation is provided.

Since the aforementioned additional image per se is not an intended print image, it is formed by the station for forming yellow images that have relatively low visibility.

While the descriptions of the first to third embodiments have been made with reference to the image forming apparatus 1 for forming images with multiple colors, the structure of the image forming apparatus is not limited to this particular feature, but it may be a monochrome image forming apparatus or an image forming apparatus having only one photosensitive drum.

It should be understood that the sizes, materials, shapes and relative positioning of the parts of the above-described image forming apparatus are not intended to restrict the scope of the present invention unless particularly stated.

What is claimed is:

1. An image forming apparatus comprising:

a movable image bearing member;

image forming means for forming a toner image on said image bearing member;

an intermediate transfer member, which is brought into contact with said image bearing member in a contact area and moved at a surficial moving speed different from a surficial moving speed of said image bearing member;

a primary transfer member, which transfers the toner image on said image bearing member onto said intermediate transfer member;

a secondary transfer member, which transfers the toner image on said intermediate transfer member onto a transferring material; and control means for controlling said toner image forming means to form dot toner images dispersed at least in an area in which said toner image does not exist on the downstream of an area in which said toner image exists in a moving direction of said intermediate transfer member in a transfer area, on which said toner image is transferred, of said intermediate transfer member.

2. An image forming apparatus according to claim 1, wherein said control means controls said toner image forming means to form the dot images in an area, which is outside a normal image formation area, and which is other than an area downstream of the normal image formation area with respect to the moving direction of said image bearing member.

3. An image forming apparatus according to claim 1, wherein in a case that the dot images are formed within a normal image formation area, said control means controls said toner image forming means to form a composite image of the normal image and the predetermined image.

4. An image forming apparatus according to claim 1, wherein said control means controls said toner image forming means to form the dot images within an area on said intermediate transfer member to which the transferring material is to be opposed, and not to form the dot images outside of the area on said intermediate transfer member to which the transferring material is to be opposed, at the time of transferring by said transferring means.

5. An image forming apparatus according to claim 1, wherein said control means controls said toner image forming means to form a dot image in which dots of a unit area formed by one dot or a plurality of dots are dispersed.

6. An image forming apparatus according to claim 5, wherein said control means controls said toner image forming means to form dot images at predetermined positions within a predetermined area dimensioned to extend by m dots in a direction perpendicular to the moving direction of said image bearing member and n dots in the moving direction of said image bearing member, wherein the dot images in the predetermined area, arranged in the moving direction of said image bearing member, are in the same positions, while the dot images in the predetermined area, arranged in the direction perpendicular to the moving direction of said image bearing member, are in positions sequentially shifted by k dots in the direction perpendicular to the moving direction of said image bearing member, where m, n and k are integers.

7. An image forming apparatus according to claim 6, wherein a greatest common divisor of m and k is 1.

8. An image forming apparatus according to claim 1, comprising a plurality of toner image forming means, wherein toner images formed by said plurality of toner image forming means are sequentially transferred onto said intermediate transfer member, wherein said control means controls said plurality of toner image forming means so that only one image forming means of said plurality of toner image forming means forms the dot images, said one toner image forming means forming a toner image to be transferred first onto said intermediate transfer member.

9. An image forming apparatus according to claim 8, wherein said one toner image forming means that forms the dot images forms the dot images with yellow toner.

10. An image forming apparatus according to claim 1, comprising a plurality of toner image forming means, wherein images formed by said plurality of toner image forming means are sequentially transferred onto said intermediate transfer member, wherein in a case that an image formation is performed by only one toner image forming means of said plurality of image forming means, said control means controls said plurality of toner image forming means so that only said one toner image forming means performs the image formation.

* * * * *

UNITED STATES PATENT AND TRADEMARK OFFICE

CERTIFICATE OF CORRECTION

PATENT NO. : 7,106,996 B2
APPLICATION NO. : 11/185779
DATED : September 12, 2006
INVENTOR(S) : Yoshihiro Funamizu et al.

It is certified that error appears in the above-identified patent and that said Letters Patent is hereby corrected as shown below:

ON TITLE PAGE ITEM (56), RC:
U.S. Patent Documents:

"6,434,354 B1" should read --6,694,354 B2--;
"6,694,114 B1" should read --6,694,114 B2--; and
"6,718,150 B1" should read --6,718,150 B2--.

COLUMN 3:
Line 65, "a" should be deleted.

COLUMN 4:
Line 25, "and" should be deleted.

COLUMN 5:
Line 1, "11*a*to" should read --11*a* to--.
Line 3, "is" should read --are--.

COLUMN 8:
Line 48, "is" should read --are--.

COLUMN 10:
Line 28, "comparting" should read --compartmentalizing--.

COLUMN 11:
Line 52, "plete" should read --completes--.

UNITED STATES PATENT AND TRADEMARK OFFICE

CERTIFICATE OF CORRECTION

PATENT NO. : 7,106,996 B2
APPLICATION NO. : 11/185779
DATED : September 12, 2006
INVENTOR(S) : Yoshihiro Funamizu et al.

It is certified that error appears in the above-identified patent and that said Letters Patent is hereby corrected as shown below:

COLUMN 12:
Line 1, “an” should read --a--.

Signed and Sealed this

Tenth Day of April, 2007

JON W. DUDAS
*Director of the United States Patent and Trademark Office*